United States Patent [19]

Hajto

[11] Patent Number: 4,500,370

[45] Date of Patent: Feb. 19, 1985

[54] EMULSION BLASTING AGENT

[75] Inventor: Ernest A. Hajto, North Bay, Canada

[73] Assignee: Du Pont Canada Inc., Montreal, Canada

[21] Appl. No.: 565,776

[22] Filed: Dec. 27, 1983

[30] Foreign Application Priority Data

Mar. 15, 1983 [GB] United Kingdom ..... 8307134

[51] Int. Cl.[3] ..... C06B 45/00

[52] U.S. Cl. ..... 149/109.6; 149/2; 149/21; 149/41; 149/46; 149/47; 149/61; 149/62; 149/69; 149/71; 149/72; 149/92; 149/93; 149/105

[58] Field of Search ..... 149/2, 21, 109.6, 41, 149/46, 61, 47, 62, 69, 92, 93, 105, 71, 72

[56] References Cited

U.S. PATENT DOCUMENTS 4,265,406 5/1981 Palgrave et al. ..... 149/109.6 X
4,331,490 5/1982 Palgrave et al. ..... 149/109.6 X

*Primary Examiner*—Stephen J. Lechert, Jr.

[57] ABSTRACT

A method for making a water-in-oil emulsion type explosive composition is disclosed. The method comprises combining a liquid carbonaceous fuel and an aqueous solution of at least one inorganic oxidizing salt, with agitation, in the presence of ingredients A and B and incorporating dispersed gas bubbles into the resulting emulsion. One of the ingredients A or B is added before or during agitation and the remaining ingredient is added during agitation. Ingredient A is oleic acid and/or linoleic acid. Ingredient B is an ammonium or alkali metal phosphate or carbonate.

10 Claims, No Drawings

EMULSION BLASTING AGENT

The present invention relates to water-in-oil emulsion type explosive compositions which contain an aqueous solution of inorganic oxidizing salt as a dispersed phase within a continuous carbonaceous fuel phase.

Water-in-oil emulsion type explosive compositions are known.

H. F. Bluhm, in U.S. Pat. No. 3,447,978 which issued June 3, 1969, discloses water-in-oil emulsion blasting agents. The blasting agents have an aqueous solution component forming a discontinuous emulsion phase, a carbonaceous fuel component forming a continuous emulsion phase and an occluded gas component dispersed within the emulsion and forming a discontinuous emulsion phase. A water-in-oil type emulsifying agent is used to form the emulsion. A large number of emulsifying agents are indicated as being suitable e.g. sorbitan fatty acid esters, polyoxyethylene sorbital esters and isopropyl ester of lanolin fatty acids. The emulsion blasting agent of Bluhm is made by mixing the aqueous solution and the carbonaceous fuel components with the emulsifying agent. The gas may be occluded during such mixing, or in a separate step after formation of the emulsion. The emulsifying agents disclosed are well known for forming water-in-oil emulsions.

E. A. Tomic, in U.S. Pat. No. 3,770,522 which issued Nov. 6, 1973, discloses a water-in-oil emulsion blasting agent which contains an ammonium or alkali metal stearate salt emulsifying agent. According to Tomic, a surprising feature of the blasting agent, in view of the fact that the value of the hydrophilic-lipophilic balance (HLB) of stearate salts is about 18, is that the stearate emulsifying agent forms a water-in-oil emulsion. In general, emulsifying agents having HLB values of 11–20, and particularly those having HLB values closer to 20, tend to form oil-in-water emulsions rather than water-in-oil emulsions. The emulsion blasting agent of Tomic is made by mixing an aqueous solution of oxidizing salts, a carbonaceous fuel component and the emulsifying agent.

W. B. Sudweeks and H. A. Jessop, in U.S. Pat. No. 4,141,767 which issued Feb. 27, 1979, disclose an emulsion blasting composition having, as an emulsifier, from about 0.5 to 5% by weight of the total composition, of a fatty acid amine or ammonium salt having a chain length from 14 to 22 carbon atoms. The method of preparing the emulsion comprises predissolving the emulsifier in a liquid hydrocarbon fuel prior to adding the emulsifier/fuel mixture to a solution of oxidizing salts. Other ingredients may be added. Examples of suitable emulsifiers disclosed are Armac* HT saturated $C_{16}$–$C_{18}$ alkylammonium acetate, Armac C $C_{12}$–$C_{18}$ alkyl-ammonium acetate and 18 Armac T unsaturated $C_{16}$–$C_{18}$ alkyl-ammonium acetate.

* denotes trade mark.

J. H. Owen, II, in U.S. Pat. No. 4,287,010 which issued Sept. 1, 1981, discloses an emulsion blasting agent comprising a carbonaceous fuel forming a continuous emulsion phase, an aqueous solution of an inorganic oxidizing salt forming a discontinuous emulsion phase dispersed in the continuous phase, dispersed gas bubbles and an ammonium or alkali metal salt of a fatty acid. The fatty acid salt is formed in situ from the fatty acid and ammonium or alkali metal hydroxide at the time when the aqueous solution and carbonaceous fuel are brought together, or just before or after they are brought together. J. H. Owen II indicates that organic derivatives of ammonium hydroxide e.g. tetramethylammonium hydroxide may be used in lieu of ammonium hydroxide.

The emulsion blasting agents of Owen are believed to have better water resistance than those of, for example, Bluhm. However, the ingredients used in the manufacture of the emulsifying aggent used for making the blasting agents of Owen tend to be difficult to handle e.g. are corrosive, and also tend to be expensive. Ingredients which overcome these disadvantages, and which provide emulsion blasting agents which tend to be stable at low temperatures, have now been found.

Accordingly the present invention provides a method for producing a water-in-oil emulsion-type explosive composition comprising:

combining a liquid carbonaceous fuel, and an aqueous solution of at least one inorganic oxidizing salt, with agitation, in the presence of ingredients A and B, ingredient A being selected from the group consisting of oleic acid, linoleic acid and mixtures thereof, and ingredient B being selected from the group consisting of phosphates and carbonates of ammonia and alkali metals, incorporating dispersed gas bubbles into the resulting water-in-oil emulsion, one of said ingredients A and B being added before or during agitation and the remaining ingredient of ingredients A or B being added during agitation.

In a preferred embodiment, ingredient A is oleic acid.

In another embodiment, ingredient B is sodium carbonate.

A preferred process comprises:

(a) adding a carbonaceous fuel, which is liquid at a temperature of at least 65° C., or an aqueous solution of at least one inorganic oxidizing salt, to a blender;
(b) agitating said aqueous solution or carbonaceous fuel;
(c) adding an emulsifier precursor ingredient to the aqueous solution or carbonaceous fuel, said precursor ingredient being selected from ingredients A and B, said ingredient A being selected from the group consisting of oleic acid, linoleic acid and mixtures thereof, said ingredient B being selected from the group consisting of phosphates and carbonates of ammonia and alkali metals;
(d) adding the carbonaceous fuel or aqueous solution which was not added during step (a);
(e) adding a second emulsifier precursor ingredient selected from ingredient A or ingredient B, whichever was not added during step (a);
(f) increasing the rate of agitation of the mixture of ingredients added to steps (a), (c), (d) and (e) so to form a water-in-oil emulsion.

In a preferred embodiment, further ingredients may be added during any of steps (a) to (f), said further ingredients being selected from fuels, explosives, gas entraining agents and solid inorganic oxidizing salts and other modifiers known in the art. Examples of solid inorganic oxidizing salts include grained or prilled ammonium nitrate (AN), sodium nitrate (SN) and calcium nitrate. Examples of fuels include liquid carbonaceous fuels e.g. formamide, fuel oil or ethylene glycol, solid carbonaceous fuels e.g. coal, gilsonite or sugar, and non-carbonaceous fuels e.g. sulphur, aluminium. Examples of explosives are prilled or flaked trinitrotoluene (TNT), monomethylamine nitrate (MMAN), pentaerythritoletranitrate (PETN) and Composition B. Examples of gas entraining agents are those agents which encapsulate the gas e.g. glass microballoons, and those agents which carry the gas in close association therewith e.g. expanded perlite, flake aluminium.

The amount of oxidizing salt employed in the present invention is generally between about 60 80 weight percent of the emulsion, and is preferably between about 70 and 78 weight percent. Preferably at least three quarters of the oxidizing salt is dissolved in aqueous solution. More preferably all of the oxidizing salt is dissolved in aqueous solution. Water is generally present between about 5 and 25 weight percent of the emulsion, preferably between 12 and 18 weight percent.

The liquid carbonaceous fuel which forms the continuous phase of the emulsion is generally present in amounts between about 2 and about 10 weight percent, preferably between about 3 and about 6 weight percent, of the emulsion. The amount selected may depend on the presence of other fuels in the emulsion and whether such other fuels are soluble or insoluble in the continuous phase. Examples of the liquid carbonaceous fuel are aliphatic, alicyclic and aromatic liquid hydrocarbons e.g. xylenes, kerosene, fuel oils, paraffin oils and other organic carbonaceous fuels. Other examples are Rando* HD-22 mineral oil, corvus oil and #2 diesel fuel.

* denotes trade mark.

Additional ingredients e.g. fuels, explosives and gas entraining agents may be added, in an amount generally up to about 12 weight percent of the emulsion.

If solid inorganic oxidizing salt e.g. grained or prilled AN, is added, it may be added alone or in combination with a fuel e.g. as ammonium nitrate/#2 diesel fuel (ANFO), or ammonium nitrate/nitropropane.

The density and sensitivity of the emulsion is affected by the presence or absence of dispersed gas bubbles in the emulsion. Such gas bubbles may be dispersed in the emulsion through incorporation of air occluded in the emulsion merely as a consequent of the agitation of the ingredients during mixing. The gas may be injected or otherwise deliberately introduced by sparging or by adding chemical agents e.g. N, N'-dinitrosopentamethylenetetramine. Alternatively the gas bubbles may be encapsulated in glass or other known materials e.g. fly as floaters. Encapsulated gas, sometimes referred to herein as microballoons, is advantageous where it is desired to detonate the emulsion under high hydrostatic pressures or in boreholes separated by low scaled distances e.g. between about 0.6 and 1.0. Generally, only about 0.5 to 2 weight percent of the microballoons in the emulsion are required to obtain the necessary pressure resistance. The required dimensions of the gas bubbles for obtaining pressure resistance and/or sensitivity are well known in the art.

The emulsions made using the present process may be made by first dissolving most or all of the inorganic oxidizing salt or salts in water and heating the resulting aqueous solution to a temperature of between about 65° and about 150° C. The solution may be added to a blender e.g. a ribbon blender or turbine blender, prior to adding one of the emulsifier precursor ingredients. It is preferred to add the precursor ingredient to the aqueous solution while agitating the solution, in order to disperse the precursor ingredient.

Although it is not necessary to do so the fatty acid precursor ingredient e.g. oleic acid is usually added to the aqueous solution. It is preferable that the temperature of the solution at this stage be between about 40° C. and 75° C. At the lower end of the temperature range, an emulsion will form when the temperature of the mixture is at or above the solubility point of the salts in solution. Addition of certain salts e.g. monomethylamine nitrate, depresses the temperature at which the emulsion may form. At the upper end of the temperature range, less agitation is required in the subsequent step in order to form an emulsion. However at temperatures above about 75° C. it may be very difficult or impossible to form an emulsion. The most preferred temperature range of the solution at this stage is from about 50° to 70° C.

The carbonaceous fuel e.g. fuel oil, is then added, while continuing agitation in the blender. Subsequently the second emulsifier precursor ingredient is added. The rate of agitation necessary to form the emulsion is easily determined through routine experimentation. The rate of agitation required to form the emulsion is higher than that required to merely blend the ingredients.

To exemplify, a 5 cm diameter laboratory mixer may require at least about 1200 revolutions per minute of the mixer blades, which a 30 cm diameter laboratory mixer may only require at least about 240 revolutions per minute of its mixer blades.

As the emulsion forms the emulsion becomes thicker and the power requirements for the blender increase sharply. The emulsion forms more easily at higher temperatures, less agitation being required than at lower temperatures. Ingredient B of the emulsifier maybe added in solid i.e. powdered, form. It is not necessary that the solid be dissolved prior to addition.

Other liquid ingredients e.g. ethylene glycol, may be added at any time prior to formation of the emulsion. Other solid ingredients may be added at any time prior to the time where the sharp increase in power requirement occurs but it is preferable that such solid ingredients be added before addition of the first emulsifier precursor ingredient.

Commercially available oleic or linoleic acids tend to be mixtures of fatty acids rather than relatively pure fatty acids e.g. oleic acid. Such mixtures are also useful in the present invention and fall within the scope of the terms "oleic acid" and "linoleic acid".

The present process may be practised in relatively small blenders e.g. holding up about 1000 kg, intended for preparing a sufficient quantity of emulsion for packaging into 25–150 mm diameter packages. The process may also be practised in large blenders e.g. holding up to about 2300 kg or more in preparation for pumping the emulsion directly into boreholes.

It has been found that the temperature of the emulsion, when in the borehole, has little effect on sensitivity, to detonation, of the explosive to detonate. Temperature of the emulsion does have a marked effect on emulsion stability, however. At low temperatures e.g. below about 4° C., crystallization of the salts in the emulsion may lead to emulsion breakdown. Presence of monomethylamine nitrate or other salts, tends to depress the lowest temperature at which emulsion breakdown becomes apparent. Presence of monomethylamine nitrate may depress this temperature at about −18° C. At high temperatures, e.g. above 40° C., evaporation may also cause instability.

The present invention may be illustrated by reference to the following examples.

EXAMPLE 1

42.1 kg of an 80 wt% ammonium nitrate solution were added, at 75° C., to a ribbon blender of 50 kg nominal capacity. 454 g of Q-Cell* 300 microballoons were added to the solution and the ribbon blades rotated at about 50 rpm for about one minute. A blend of 1589 g Rando HD-22 mineral oil and 795 g oleic acid was added to the blender, agitation of the ribbon blades at 50 rpm being continued for one minute. 681 g sodium carbonate were added to the blender and the ribbon blade rotation was increased to 250 rpm for about 10 minutes. An emulsion was formed, the final temperature being about 68° C. and the density, at 20° C., being about 1.30 g/cm$^3$.

* denotes trade mark.

The viscosity of the emulsion, after cooling to 50° C., was 315 Pa.s. Over a period of 7 days, the viscosity increased to 450 Pa.s at 21° C. Viscosity was measured using a Brookfield* VFN viscometer.

The emulsion explosive detonated at 4878 m/s, confined at 4° C. in 15 mm diameter when primed with a No. 8 blasting cap and a 450 g TNT booster.

EXAMPLE 2

Example 1 was separated except that 41.7 kg of 80% ammonium nitrate solution were used and 908 g of expanded perlite was used instead of the Q-Cell microballons. The final density was 1.22 g/cm$^3$. Initial viscosity was measured at 450 Pa.s at 50° C. The viscosity, after 7 days, was measured at 575 Pa.s at 21° C. The emulsion detonated at 5081 m/s under the same conditions as in Example 1.

EXAMPLE 3

367 g of an 80 wt. % ammonium nitrate solution were added, at 70° C. to a laboratory blender. To this solution were added, under agitation of 100 revolutions per minute of the turbine blades, 4 g of Q-cell 300 microballoons, 14 g of Rando HD-22 oil and 7 g oleic acid. Agitation was increased to 1200 revolutions per minute and 8 g of trisodium phosphate was added. After one minute, agitation was further increased to 200 revolutions per minute for an additional minute. An oil-in-water emulsion formed, having a viscosity of 105 Pa.s measured to 56° C.

I claim:

1. A method for producing a water-in-oil emulsion-type explosive composition which comprises combining with agitation, a liquid carbonaceous fuel, an aqueous solution of at least one inorganic oxidizing salt, dispersed gas bubbles and ingredients A and B, ingredient A being selected from the group consisting of oleic acid, linoleic acid, and mixtures thereof, and ingredient B being selected from the group consisting of phosphates and carbonates of ammonia and alkali metals, at least one of said ingredients A and B being added during agitation.

2. A method according to claim 1 wherein ingredient A is oleic acid.

3. A method according to claim 1 wherein ingredient B is sodium carbonate.

4. A method according to claim 3 wherein ingredient B is sodium carbonate.

5. A method for producing a water-in-oil emulsion-type explosive composition comprising:

(a) adding a carbonaceous fuel, which is liquid at a temperature of at least 65° C., or an aqueous solution of at least one inorganic oxidizing salt, to a blender;

(b) agitating said aqueous solution or carbonaceous fuel;

(c) adding an emulsifier precursor ingredient to the aqueous solution or carbonaceous fuel, said precursor ingredient being selected from the group consisting of ingredient A and ingredient B, said ingredient A being selected from the group consisting of oleic acid, linoleic acid and mixtures thereof, said ingredient B being selected from the group consisting of phosphates and carbonates of ammonia and alkali metals;

(d) adding the carbonaceous fuel or aqueous solution which was not added during step (a);

(e) adding a second emulsifier precursor ingredient selected from ingredient A or ingredient B, whichever was not added during step (a);

(f) increasing the rate of agitation of the mixture of ingredients added in steps (a), (c), (d) and (e) so to form a water-in-oil emulsion.

6. A method according to claim 5 wherein ingredient A is oleic acid.

7. A method according to claim 5 wherein ingredient B is sodium carbonate.

8. A method according to claim 4 wherein ingredient A is oleic acid and ingredient B is sodium carbonate.

9. A method according to claim 6 wherein the amount of oxidizing salt is from about 60 to 80 wt. %, the amount of water is from about 5 to 25 wt. % and the amount of liquid carbonaceous fuel is between about 2 and 10 wt. %, the total quantity of ingredients being 100%.

10. A method according to claim 7 wherein the amount of oxidizing salt is from about 60 to 80 wt. %, the amount of water is from about 5 to 25 wt. % and the amount of liquid carbonaceous fuel is between about 2 and 10 wt. %, the total quantity of ingredients being 100%.

* * * * *